US006019617A

United States Patent [19]

Liu et al.

[11] Patent Number: 6,019,617

[45] Date of Patent: Feb. 1, 2000

[54] PICK-UP DEVICE FOR AN ELECTRICAL CONNECTOR AND ELECTRICAL CONNECTOR HAVING THE SAME

[75] Inventors: Jia-Hung Liu, Hsin-Chuang; Jerry Wu, Ho-May Chen, both of Taiwan

[73] Assignee: Hon Hai Precision Ind. Co., Ltd., Taipei Hsien, Taiwan

[21] Appl. No.: 09/094,233

[22] Filed: Jun. 9, 1998

[30] Foreign Application Priority Data

Jun. 10, 1997 [TW] Taiwan ..... 86209678

[51] Int. Cl.[7] ..... H01R 13/44

[52] U.S. Cl. ..... 439/135; 439/41

[58] Field of Search ..... 439/41, 135, 148, 439/149, 150, 940

[56] References Cited

U.S. PATENT DOCUMENTS 5,688,133 11/1997 Ikesugi et al. ..... 439/135

*Primary Examiner*—Paula Bradley
*Assistant Examiner*—Alex Gilman

[57] ABSTRACT

An electrical connector comprises an insulative housing having a bottom plate defining a longitudinal direction, two longitudinal side walls extending upward from the bottom plate, four channels each defined through an upper edge of the side walls, and pick-up means having a main body defining a smooth upper surface and four downward extending resilient legs for retaining in said channels of the housing. The channels of the housing can be provided on the bottom plate of the housing rather than in the side walls thereof.

11 Claims, 5 Drawing Sheets

PICK-UP DEVICE FOR AN ELECTRICAL CONNECTOR AND ELECTRICAL CONNECTOR HAVING THE SAME

BACKGROUND OF THE INVENTION

1. Field of The Invention

The present invention relates to an electrical connector, and more particularly to an electrical connector having a picking cap.

2. The Prior Art

Conventional electrical connectors including pick-up means for facilitating picking up and positioning by a pick-up machine such as a vacuum suction nozzle or the like can be found in Taiwan Patent Application No. 83207484 and U.S. Pat. Nos. 4,396,245, 4,645,278, 5,026,295, 5,055,971, 5,242,311, 5,249,977, 5,277,601, 5,383,797, and 5,688,133. In these connectors, a top of the connector has an adhesive film adhesively attached thereto or a cap having a smooth top surface disposed thereon to provide a surface suitable for picking up by the vacuum suction nozzle. However, it is difficult to remove the adhesive film which is usually directly attached to the connector, and the adhesive film can only be used once. Furthermore, the pick-up cap might damage either the conductive contacts or the insulative housing of the connector.

Hence, an electrical connector including an improved pick-up means which can overcome the above mentioned defects of conventional electrical connectors is requisite.

SUMMARY OF THE INVENTION

Accordingly, one object of the present invention is to provide an electrical connector having improved pick-up means for facilitating picking up and positioning by a pick-up machine.

Another object of the present invention is to provide an electrical connector having improved pick-up means for facilitating picking up and positioning by a vacuum suction nozzle.

One more object of the present invention is to provide an electrical connector having improved pick-up means which will not damage the conductive contacts of the connector.

One further object of the present invention is to provide an electrical connector having improved pick-up means which will not damage the insulative housing of the connector.

To fulfill the above-mentioned objects, according to a preferred embodiment of the present invention, an electrical connector comprises an insulative housing having a bottom plate defining a longitudinal direction, two longitudinal side walls extending upward from the bottom plate, and at least one channel defined through an upper edge of the side walls; a plurality of conductive contacts extending through a plurality of passages defined through the bottom plate, respectively; pick-up means having a main body defining a smooth upper surface and at least one downward extending resilient leg for retaining in the at least one channel of the housing. The resilient leg of the pick-up means may comprise a projection projecting in the longitudinal direction and the channel of the housing may comprise a stopper projecting in the longitudinal direction. In addition, the pick-up means can be integrally formed by stamping and forming of a single metal sheet. A notch can be provided immediately adjacent to each leg on an edge of the main body and between two legs of the same lateral edge thereof.

According to a second embodiment of the present invention, the channel can be provided on the bottom plate of the housing rather than in the side walls thereof.

According to another aspect of the present invention, pick-up means for an article comprises a main body having a smooth upper surface and at least one resilient leg extending from the main body and defining a plane, the at least one resilient leg including a projection projecting into the plane defined by the at least one resilient leg.

These and additional objects, features, and advantages of the present invention will become apparent after reading the following detailed description of the preferred embodiments of the present invention taken in conjunction with the appended drawing figures described briefly immediately below.

DETAILED DESCRIPTION OF THE PREFERRED EMBODIMENT

Reference will now be made in detail to the preferred embodiments of the present invention.

Figure 1:
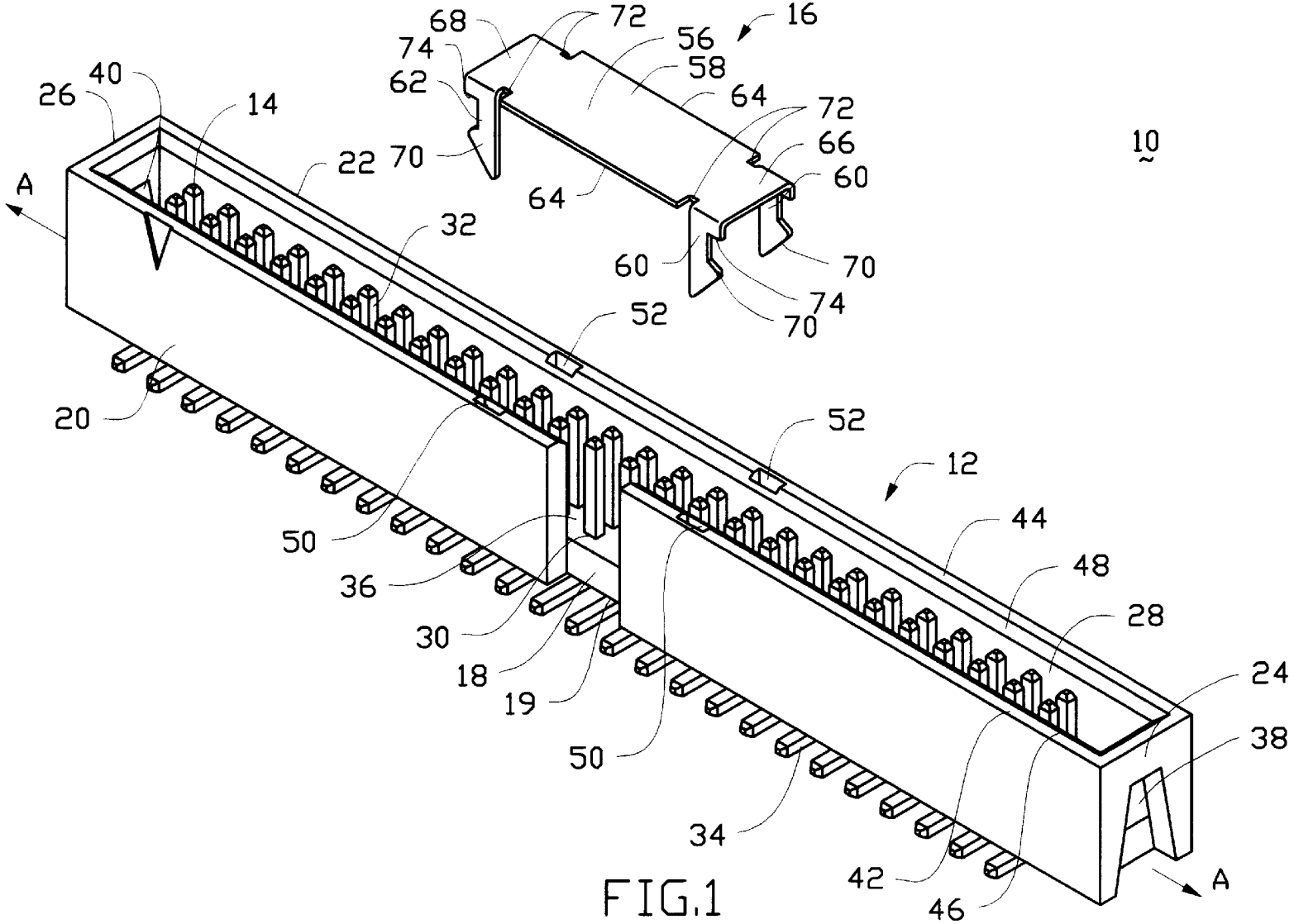
FIG. 1 is an exploded perspective view of an electrical connector including pick-up means in accordance with a first preferred embodiment of the present invention.

Referring to FIG. 1, an electrical connector 10 in accordance with the present invention comprises an insulative housing 12, a plurality of conductive contacts 14, and a pick-up device 16.

The housing 12 comprises a bottom plate 18 defining a longitudinal axis "A", two longitudinal side walls 20, 22, two opposite end walls 24, 26, and a central cavity 28 defined between the walls 20, 22, 24 and 26. Two rows of contact receiving passages 30 are defined in the bottom plate 18 for receiving a corresponding number of contacts 14 therethrough. Each contact 14 comprises a vertical mating section 32 extending upward from the bottom plate 18 for mating with another connector (not shown) and a horizontal soldering section 34 extending laterally from a bottom surface 19 of the bottom plate 18 for soldering onto a surface of a printed circuit board (not shown). A rectangular cut-out 36 is formed in the side wall 20 and a pair of inverted V-shaped openings 38, 40 are formed in both the end walls 24, 26. The side walls 20, 22 each defines an upper edge 42, 44 and an inner chamfered surface 46, 48. Two pairs of vertical channels 50, 52 are defined in the side walls 20, 22 through the upper edges 42, 44 and each of the vertical channels 50, 52 includes a stopper 54 (shown in FIG. 3) projecting in the longitudinal direction "A".

The pick-up device 16 is integrally formed, for example, by stamping and forming a single metal sheet, as a one-piece unit and comprises a rectangular main body 56 having a smooth upper surface 58 for receiving vacuum suction from a pick-up machine (not shown) and two pairs of resilient legs 60, 62 respectively extending downward from opposite ends 66, 68 of longitudinal edges 64 thereof. A longitudinal projection 70 is formed on a lower end of each leg 60, 62 for retention by the stopper 54 of the channel 50, 52 when the legs 60, 62 are inserted into the channels 50, 52. Two rectangular notches 72 are formed on each lateral edges 64 between two legs 60, 62 of the same side immediately adjacent to the corresponding leg 60, 62 for providing better resilience thereto. Each of the legs 60, 62 further comprises a downward facing shoulder 74 for being supported on the corresponding upper edge 42, 44 of the side wall 20, 22.

Figure 2:
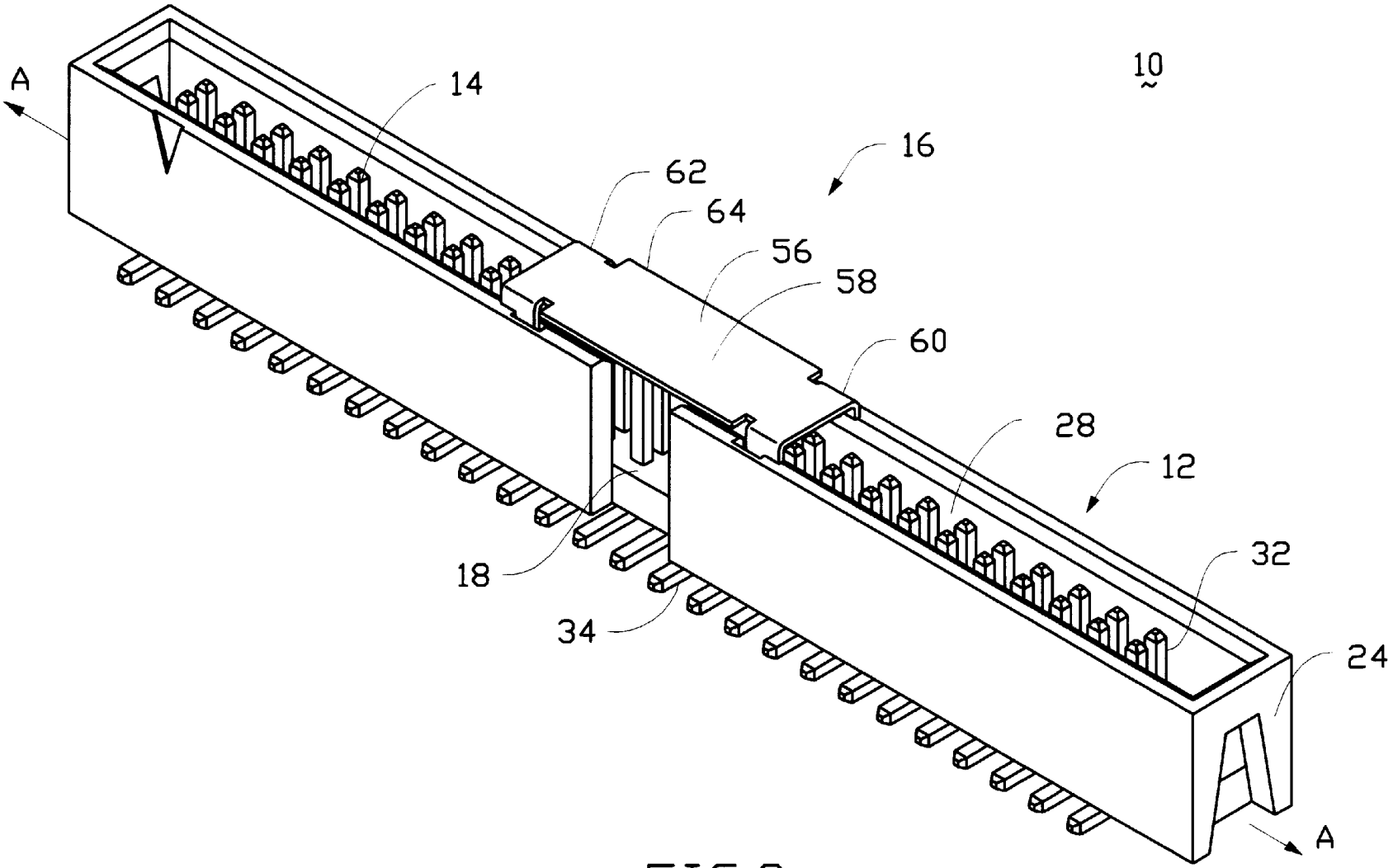
FIG. 2 is an assembled perspective view of the electrical connector shown in FIG. 1.
Figure 3:
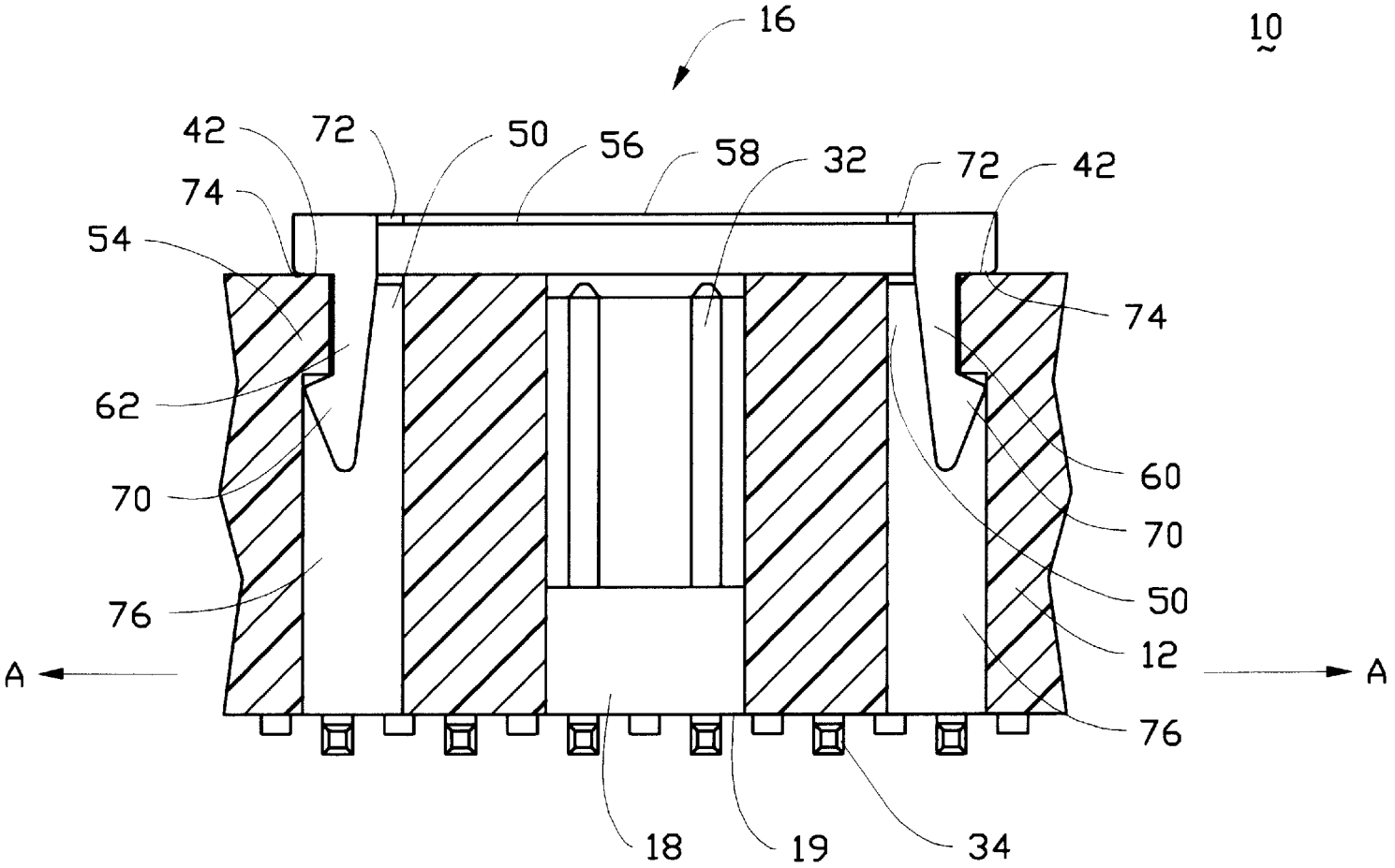
FIG. 3 is a partially cut-away cross-sectional view of the electrical connector shown in FIG. 2.

Please refer to FIG. 2 which shows the connector 10 with the pick-up device 16 mounted thereon and to FIG. 3 which shows the engagement between the pick-up device 16 and the housing 12. When the pick-up device 16 is mounted on the housing 12, the four resilient legs 60, 62 of the pick-up device 16 are respectively inserted into the four channels 50, 52 of the side walls 20, 22 of the housing 12. The legs 60, 62 on the same longitudinal side then resiliently bend towards each other since each of the longitudinal projections 70 is urged by a lateral surface (not labeled) of the corresponding stopper 54. Finally, the shoulders 74 of the legs 60, 62 rest on the upper edges 42, 44 of the side walls 20, 22 and the projections 70 slide across the corresponding stoppers 54 and the legs 60, 62 resile outward into a recess 76 defined under the stopper 54. The main body 56 of the pick-up device 16 is then horizontally supported above the housing 12 by the shoulders 74 and the upward movement of the legs 60, 62 with respect to the channels 50, which is hindered by the cooperation between the projections 70 and the stoppers 54.

Since the force necessary to separate the pick-up device 16 from the housing 12 is designed to be substantially larger than the weight of the connector 10 minus that of the pick-up device 16, the connector 10 is thus prepared to be moved by a pick-up machine (not shown) by applying a vacuum suction nozzle to the smooth upper surface 58 of the main body 56 of the pick-up device 16.

Figure 4:
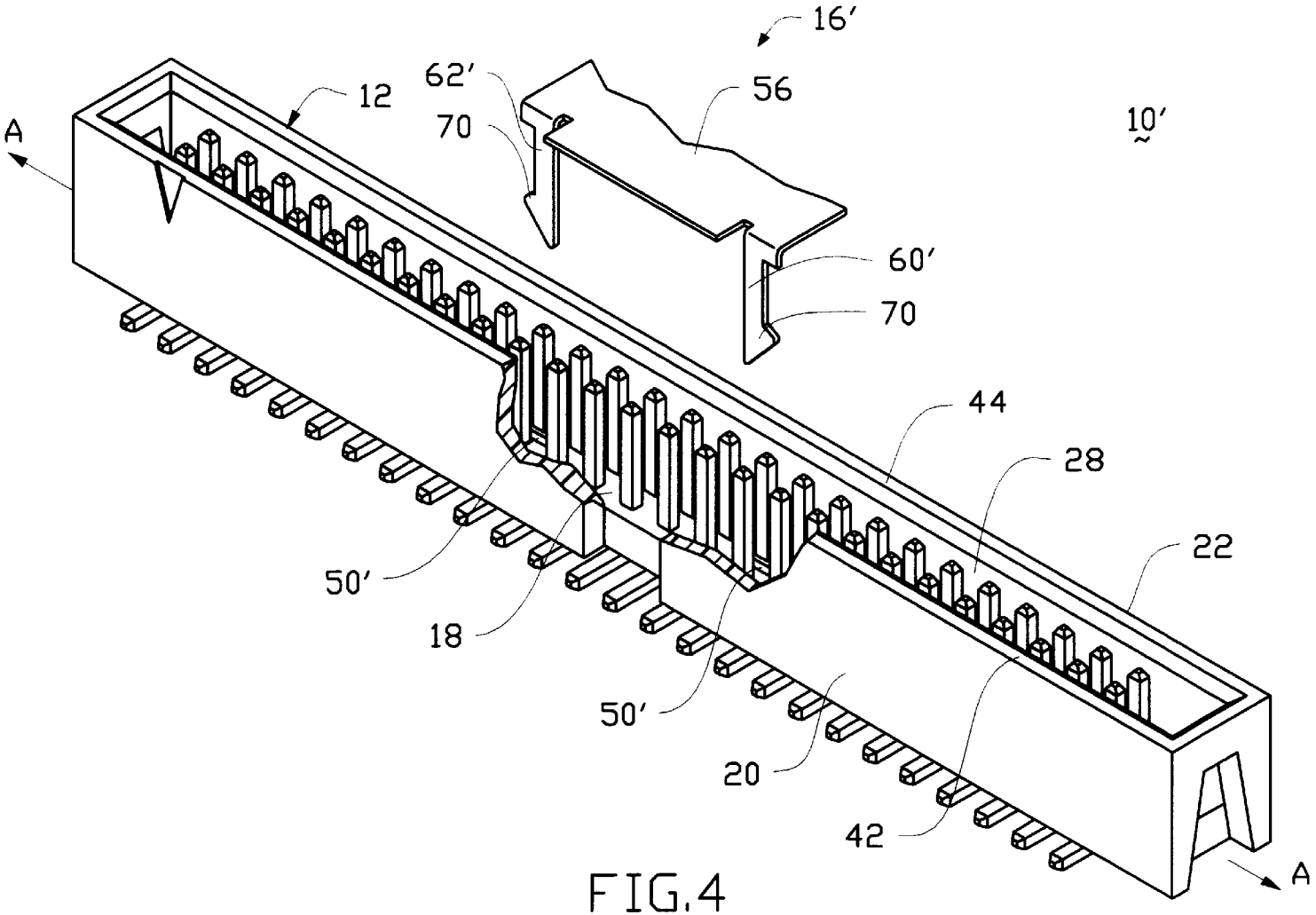
FIG. 4 is a partially cut-away exploded perspective view of an electrical connector including pick-up means in accordance with a second preferred embodiment of the present invention.
Figure 5:
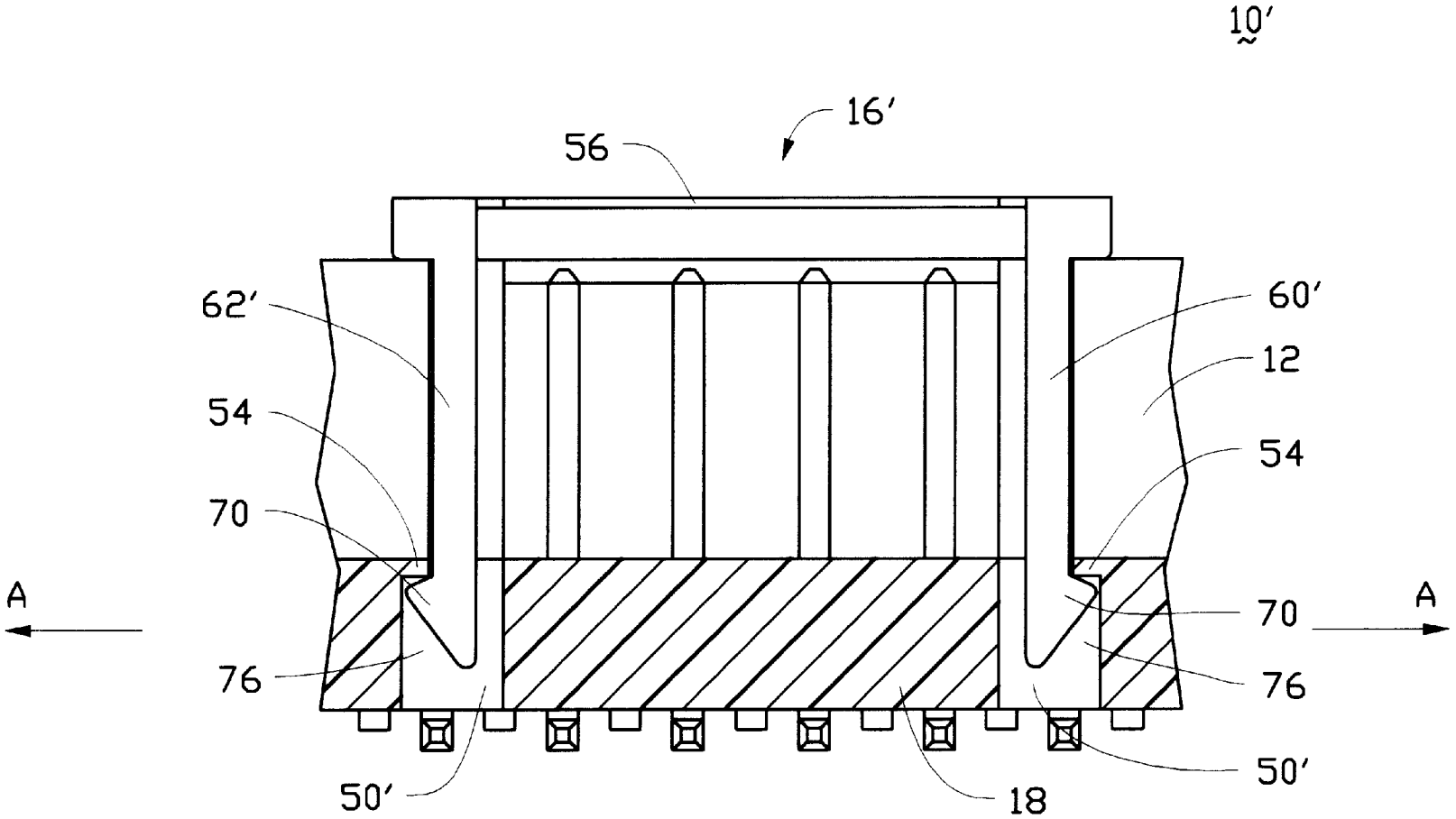
FIG. 5 is a partially cut-away cross-sectional view of the assembled electrical connector shown in FIG. 4.

FIGS. 4 and 5 show an electrical connector 10' including a pick-up device 16' according to a second embodiment of the present invention. In this embodiment, there are two main differences from the connector 10. First, four channels 50' are provided through the bottom plate 18 of the housing 12 of the connector 10' rather than in the side walls 20, 22 of the housing 12. Second, the main body 56 (only a portion thereof is shown) of the pick-up device 16' extend laterally at lease above the upper edges 42, 44 of the side walls 20, 22 to prevent excessive insertion thereof. The distance defined between two legs 60' (or 62') at the same end is smaller than the width of the central cavity 28 defined between the side walls 20, 22, and the length of each of the legs 60', 62' may be longer than that of each of the legs 60, 62.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. An electrical connector, comprising:

an insulative housing having a bottom plate defining a longitudinal direction, two longitudinal side walls extending upward from the bottom plate, and a pair of channels defined in top surface of each of said side walls;

a plurality of conductive contacts respectively extending through a plurality of passages defined through the bottom plate;

a pick-up device having a main body defining a smooth upper surface and a pair of resilient legs extending downward from opposite edges of the main body for retaining in corresponding channels in the side walls of the housing.

2. The electrical connector as claimed in claim 1, wherein each resilient leg of the pick-up device comprises a projection projecting in said longitudinal direction for engaging with corresponding channel of the insulative housing.

3. The electrical connector as claimed in claim 1, wherein each channel of the housing further comprises a stopper in the longitudinal direction for engaging with corresponding resilient leg of the pick-up device.

4. The electrical connector as claimed in claim 1, wherein each channel of the housing further comprises a recess defined for engaging with corresponding resilient leg of the pick-up device.

5. The electrical connector as claimed in claim 1, wherein a notch is defined in the main body of the pick-up device immediately adjacent to each resilient leg for providing the resilient leg with appropriate resiliency.

6. The electrical connector as claimed in claim 1, wherein each resilient leg of the pick-up device comprises a downward facing shoulder in the longitudinal direction for resting on the top surface of corresponding side wall of the housing.

7. An electrical connector, comprising:

an insulative housing having a bottom plate and a pair of channels defined in the bottom plate adjacent to opposite edges thereof, respectively;

a plurality of conductive contacts respectively extending through a plurality of passages defined through the bottom plate; and a pick-up device having a main body defining a smooth upper surface and a pair of resilient legs respectively extending downward from opposite edges of the main body for engaging within corresponding channels in the bottom plate of the housing.

8. The electrical connector as claimed in claim 7, wherein said insulative housing further comprises two longitudinal side walls extending upward from the bottom plate, and said main body of the pick-up device extends transversely over upper edges of said side walls when the pick-up device is mounted to the housing.

9. The electrical connector as claimed in claim 7, wherein each resilient leg of the pick-up device comprises a projection projecting in said longitudinal direction for engaging with corresponding channel of the insulative housing.

10. The electrical connector as claimed in claim 7, wherein each channel of the housing comprises a recess defined in said longitudinal direction for engaging with corresponding resilient leg of the pick-up device.

11. The electrical connector as claimed in claim 7, wherein each channel of the housing comprises a stopper projecting in said longitudinal direction for engaging with corresponding resilient leg of the pick-up device.

* * * * *